United States Patent [19]

Baker

[11] 4,122,891

[45] Oct. 31, 1978

[54] SECTOR PLATE SUPPORT

[75] Inventor: Roderick J. Baker, Belmont, N.Y.

[73] Assignee: The Air Preheater Company, Inc., Wellsville, N.Y.

[21] Appl. No.: 830,533

[22] Filed: Sep. 6, 1977

[51] Int. Cl.[2] ..... F28D 19/00

[52] U.S. Cl. ..... 165/9; 277/26

[58] Field of Search ..... 165/9; 277/26

[56] References Cited

U.S. PATENT DOCUMENTS

| | | | |
|---|---|---|---|
| 3,404,727 | 10/1968 | Mock | 165/9 |
| 3,786,868 | 1/1974 | Finnemore | 165/9 |

FOREIGN PATENT DOCUMENTS

| | | | |
|---|---|---|---|
| 264,591 | 3/1970 | U.S.S.R. | 165/9 |

*Primary Examiner*—Albert W. Davis, Jr.

*Attorney, Agent, or Firm*—Wayne H. Lang

[57] ABSTRACT

Rotary regenerative heat exchange apparatus having a rotor containing a mass of heat absorbent element that is slowly rotated about a vertical axis in order that the element may be alternately exposed to a heating fluid and to a fluid to be heated. The rotor is surrounded by a housing including a sector plate at opposite ends thereof adapted to separate the several fluids. The sector plate is divided into a plurality of radially adjacent sections, each of which is independently actuated into a preferred sealing relationship with the adjacent face of the rotor.

5 Claims, 3 Drawing Figures

SECTOR PLATE SUPPORT

BACKGROUND OF THE INVENTION

In rotary regenerative heat exchange apparatus, a mass of heat absorbent element commonly comprised of packed element plates is first positioned in a hot gas passageway to absorb heat from hot gases passing therethrough. After the plates become heated by the hot gases they are moved into a passageway for a cool fluid such as air where the hot plates give up their heat to cool air or other gas passing therethrough.

The heat absorbent material is carried in a rotor that rotates between the hot and cool fluids, while fixed housing structure including sector plates at opposite ends of the rotor is adapted to surround the rotor and direct the hot and cool fluids therethrough. To prevent mingling of the hot and cool fluids, the end edges of the rotor are provided with flexible sealing members that rub against adjacent surface members of the rotor housing to resiliently accommodate a limited degree of rotor "turndown" or other distortion caused by mechanical loading and thermal distortion of the rotor.

To permit turning the rotor freely about its axis, certain minimum clearance space between the rotor and adjacent housing structure is required, however, excessive clearance space is to be avoided because it will result in excessive leakage through the space therebetween. However, uneven expansion between the rotor and rotor housing may open a path for excessive leakage and a lower effectiveness may result.

The expansion of the rotor and adjacent housing structure assumes greatest proportions directly adjacent the inlet for the hot fluid where the rotor and rotor housing are both subjected to a maximum amount of thermal expansion and distortion. An arrangement that compensates for a loss of sealing effectiveness at this, the "hot" end of the rotor, is shown by U.S. Pat. No. 3,786,868 where a plane sector plate is pivoted about a fulcrum carried by the housing. Other patents represented by U.S. Pat. No. 3,404,727 separate a sector plate into radially adjacent sections, and then counter-balance each section into a preferred relationship with the adjacent face of the rotor.

Although the arrangements defined are partially effective in reducing some leakage of fluid through the clearance space between the rotor and adjacent sector plate, leakage continues to be a major problem because each portion of the sector plate expands linearly while the face of the rotor lying adjacent thereto expands both radially and axially to assume a dished configuration. Therefore, an increase of temperature usually indicates a differential of expansion and an increase in the amount of fluid leakage between the several relatively rotatable parts of the rotor.

SUMMARY OF THE INVENTION

In accordance with my invention I therefore provide a sector plate that is divided into radially adjacent sections that are hinged together but operatively independent from one another. Each section is actuated independently to assume a position that lies closely adjacent the end of the rotor whereby there will be a minimum of leakage from a developing space therebetween.

BRIEF DESCRIPTION OF THE DRAWINGS

A more complete understanding of my invention may be realized by referring to the following description in conjunction with the accompanying drawings in which.

DESCRIPTION OF THE PREFERRED EMBODIMENT

Figure 1:
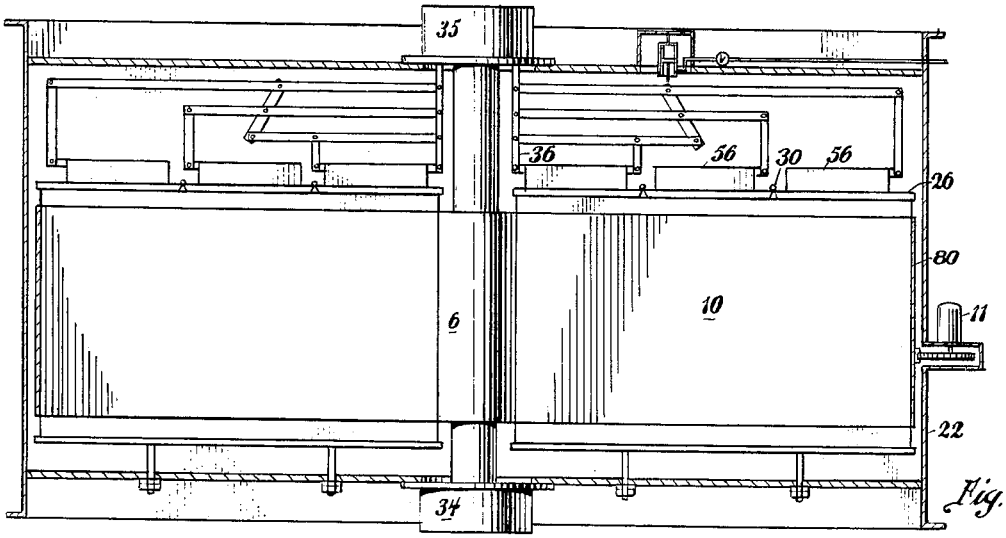
FIG. 1 is a cross section of a rotary regenerative heat exchanger involving the present invention.

The heat exchanger of this invention includes a vertical rotor post 6 and a concentric rotor shell 8 with a space therebetween that is filled with a mass of permeable heat absorbent material 10 in order that the heat absorbent material will absorb heat from a hot heating fluid and transfer it to a cool fluid to be heated.

Hot exhaust gases or other heating fluid enter the heat exchanger through an inlet duct 12 to be discharged through an outlet duct 14 after having passed over the heat absorbent material 10 being rotated by motor 11. Cool air or other fluid to be heated enters the heat exchanger through an inlet duct 16 and is discharged after flowing over the heated material through an outlet duct 18 to which an induced draft fan (not illustrated) is usually connected. After passing over the hot heat absorbent material 10 and absorbing heat therefrom, the heated fluid is directed to its place of ultimate use.

A cylindrical housing 22 encloses the rotor in spaced relation thereto to provide an annular space 24 therebetween that permits independent movement of the rotor about its axis. Sector plates 26 intermediate ends of the rotor and adjacent housing structure are adapted to separate the stream of heating fluid from the fluid to be heated. To prevent leakage of one fluid stream to the other, it is customary to affix flexible sealing means to an end edge of the rotor so that it may confront the adjacent surface of the rotor housing to preclude the flow of fluid therebetween.

In a standard heat exchanger of the type defined herein, the hot gas enters the heat exchanger through an inlet duct 12 at the top of the housing and flows downward to transfer its heat to the heat absorbent material 10 before it is discharged as cooled gas through outlet duct 14. Inasmuch as the inlet for the fluid to be heated lies adjacent the outlet for the cooled gas at the bottom of the heat exchanger, the lower end of a typical heat exchanger is called the "cold" end and the end adjacent the inlet for the heating fluid is termed the "hot" end of the heat exchanger. It will be apparent that the "hot" end of the rotor will be subject to maximum temperature variation while the "cold" end of the rotor will be subjected to considerably less temperature variation and thermal expansion that results therefrom.

Figure 3:
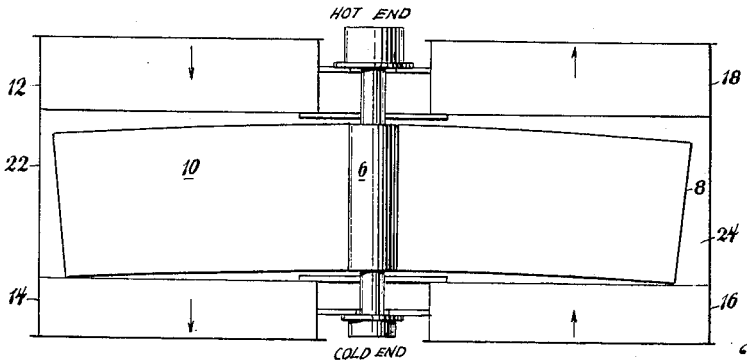
FIG. 3 is a diagrammatic representation of a typical rotor being subjected to excessive heat at the "hot" end thereof.

Thus maximum thermal expansion of the rotor and adjacent rotor housing occurs at the "hot" end of the rotor with the result that the rotor assumes a deformation or "turndown" similar to that of an inverted dish shown by FIG. 3. The result of this "turndown" is to increase the clearance space between the rotor and the adjacent rotor housing and substantially increase the leakage of fluid between relatively movable parts.

A lower support bearing 34 is mounted rigidly on independent support structure whereby the central rotor shaft 6 that supports the rotor may be rotated about a fixed vertical axis. As the rotor and rotor shaft are heated they are permitted to expand axially while they are precluded from radial movement by a guide bearing 35 at the "hot" end of the rotor.

Figure 2:
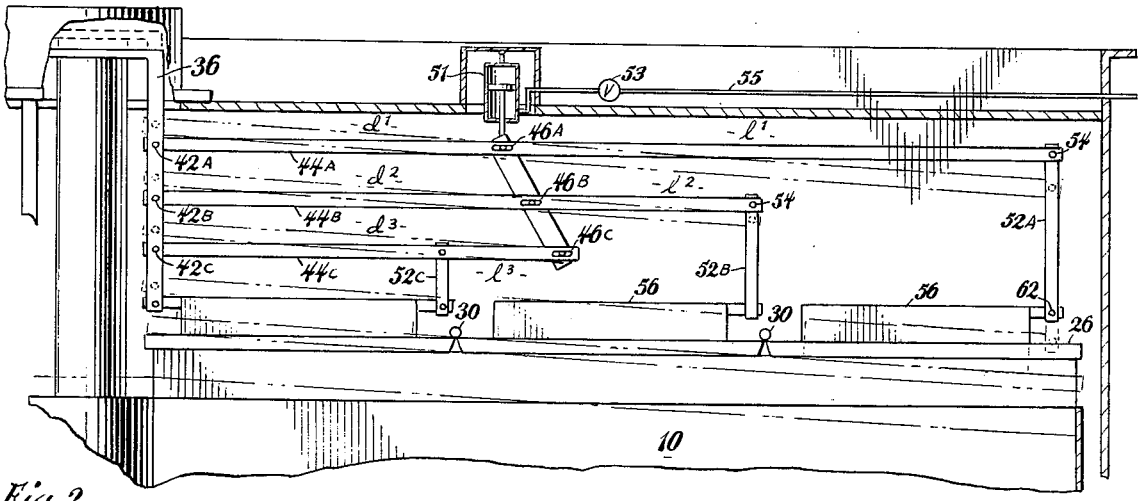
FIG. 2 is an enlarged showing of a pivoted sector plate with spaced actuating levers.

The present invention provides a sector plate 26 at the "hot" end of the rotor that separates the heating fluid from the fluid to be heated. Each sector plate at the "hot" end of the rotor is divided into independent radially adjacent portions that are pivotally joined by elongate hinges 30 in the manner shown by FIG. 2, and each independent portion of the sector plate has an actuator that forces it to be displaced axially an amount that corresponds to displacement of the adjacent rotor structure so there will be a minimum of fluid leakage therebetween.

To carry out controlled actuation of each portion of the sector plate as above defined, I provide an actuator 36 that depends from the guide bearing housing or the like so that it will move up or down in direct response to thermal expansion of the rotor post 6. Pivotally attached to the actuator at axially spaced locations 42A, 42B, and 42C are a series of lever bars 44A, 44B, and 44C that impart a vertical movement to the hangers 52 and the respective sections of the pivoted sector plate.

The lever 44A is mounted for movement about a fulcrum 46A on the connecting plate 48 or other fixed housing structure lying at the end of the rotor. Other lever bars 44B and 44C are similarly pivoted to fixed housing structure or to a link 50 that is itself pivotally mounted upon the housing. The link 50 may be pivotally mounted on an actuator 51 that is adapted to quickly move the link 50 and associated lever bars vertically when "bottled-up" or other unnatural conditions exist. Thus actuation of valve 53 will supply a quantity of pressurized fluid from a source 55 to actuator 51 to quickly move link 50, lever bars 44, hangers 52, and the related sections of the sector plate 26 vertically away from the adjacent face of the rotor when conditions that cause excessive interference therebetween are detected. Each section of the sector plate is provided with a box type stiffener 56 that is adapted to be bonded to the upper surface thereof to maintain said surface at all times substantially plane. The stiffeners 56 provide a prime base for attaching the respective hangers 52 thereto by suitable pivot pins 62 whereby each independent division of the sector plate is pivotally connected to a lever arm 44 which is in turn connected to the actuating bar 36.

Inasmuch as the greatest amount of rotor "turndown" occurs at the radial outboard end of the rotor while a progressively smaller amount of "turndown" occurs at the more radially inboard sections, each section of the pivoted sector plate is actuated an amount that is determined by the degree of "turndown" at the directly adjacent portion of the rotor whereby there will be a minimum amount of clearance space therebetween.

To obtain the proper positioning of each fulcrum 46, operating conditions of the rotor must be known so that the distance $d^1$, $d^2$, and $d^3$ from the actuating rod 36 to the respective fulcrum may be calculated according to well-known rules to obtain a predetermined vertical movement at the sector plate in accordance with movement of the actuator 36 and known lever arms.

By properly spacing each fulcrum 46 to vary the relative lengths of lever arms $d^1$, $d^2$, and $d^3$ with respect to lever arms $1^1$, $1^2$, and $1^3$, vertical movement of the actuated sector plate may be made to conform closely to the contour of the rotor so there will be a minimum of leakage therebetween.

While lever 44C is illustrated as a "second class" lever that imparts a predetermined manner of actuation to the innermost section of the sector plate 26, it is to be realized that other linkages may be utilized to impart a predetermined movement thereto to match known rotor "turndown". Thus various changes may be made without departing from the spirit of the invention, and all matter contained in the above description or shown in the accompanying drawings is to be interpreted as illustrative and not in a limiting sense.

I claim:

1. Rotary regenerative heat exchange apparatus having a rotor including a central rotor post and a concentric rotor shell spaced therefrom to provide an annular space therebetween, a mass of heat absorbent material carried in the space between the rotor post and the rotor shell, a housing surrounding the rotor in spaced relation including inlet and outlet ducts at opposite ends thereof for a heating fluid and for a fluid to be heated, a support bearing at one end of the rotor adapted to support the rotor for rotation about its axis, a guide bearing at the opposite end of the rotor adapted to preclude radial movement of the rotor post, means for rotating the rotor about its axis, an articulated sector plate having radially adjacent plane sections pivotally joined to separate the heating fluid from the fluid to be heated, axially disposed support means adjacent the rotor post movable in response to axial expansion of the rotor post, an actuator for each section of the sector plate comprising a lever extending radially outward from the axial support means, a pivotal linkage connecting each lever to the support means and to an independent section of the sector plate, and a fulcrum for each lever actuator mounted on said housing to provide an axial movement to each section of the sector plate in response to axial movement of the rotor post.

2. Rotary regenerative heat exchange apparatus as defined in claim 1 including stiffeners affixed to each section of the sector plate to preclude thermal distortion thereof.

3. Rotary regenerative heat exchange apparatus as defined in claim 1 including an elongate arm that supports a fulcrum for each radial lever.

4. Rotary regenerative heat exchange apparatus as defined in claim 3 wherein the elongate arm member is pivotally attached to the housing to provide support means for each lever.

5. Rotary regenerative heat exchange apparatus as defined in claim 4 including a vertical drive means, and means linking the elongate arm member to the vertical drive means to move the arm member away from the adjacent face of the rotor.

* * * * *